US010422513B2

(12) United States Patent
Bittmann

(10) Patent No.: US 10,422,513 B2
(45) Date of Patent: Sep. 24, 2019

(54) LIGHTING DEVICE INCLUDING INTERCONNECTED PARTS

(71) Applicant: OSRAM GmbH, Munich (DE)

(72) Inventor: Thomas Bittmann, Friedberg (DE)

(73) Assignee: LEDVANCE GMBH, Garching Bei Munich (DE)

( * ) Notice: Subject to any disclaimer, the term of this patent is extended or adjusted under 35 U.S.C. 154(b) by 332 days.

(21) Appl. No.: 14/093,546

(22) Filed: Dec. 2, 2013

(65) Prior Publication Data

US 2014/0153231 A1 Jun. 5, 2014

(30) Foreign Application Priority Data

Dec. 3, 2012 (DE) ..... 10 2012 222 103

(51) Int. Cl.

| | |
|---|---|
| ***F21V 17/10*** | (2006.01) |
| ***F21K 9/272*** | (2016.01) |
| ***F21V 3/06*** | (2018.01) |
| ***F21V 31/04*** | (2006.01) |
| ***F21Y 115/10*** | (2016.01) |

(Continued)

(52) U.S. Cl.

CPC ..... *F21V 19/002* (2013.01); *F21K 9/23* (2016.08); *F21K 9/272* (2016.08); *F21V 17/101* (2013.01); *F21K 9/90* (2013.01); *F21V 3/061* (2018.02); *F21V 31/04* (2013.01); *F21Y 2115/10* (2016.08)

(58) Field of Classification Search

CPC ... F21K 9/175; F21K 9/17; F21K 9/90; F21K 9/272; F21K 9/275; F21K 9/232; F21K 9/235; F21K 9/237; F21K 9/27; F21K 9/23; F21V 19/008; F21V 19/002; F21V 17/101; F21V 31/04; F21V 3/0418; F21V 19/009; H01J 5/48; H01J 5/58; H01J 5/60; H01J 5/52; H01J 5/54; H01J 5/56; H01J 5/50; H01J 5/22; H01J 5/24; H01J 5/30; H01J 61/361; H01J 9/34; H01J 9/265; H01J 11/48; H01J 13/26; H01J 17/183; H01J 5/20; H01J 5/26; H01J 5/28

USPC ..... 313/318.08, 318.1, 318.02; 439/612; 403/179

See application file for complete search history.

(56) References Cited

U.S. PATENT DOCUMENTS 430,485 A * 6/1890 Rockwell ..... H01J 5/50 439/611
1,873,776 A * 8/1932 McNeil ..... H01J 9/34 156/294

(Continued)

FOREIGN PATENT DOCUMENTS

CN 102313167 A 1/2012
DE 102010029226 A1 11/2011

(Continued)

OTHER PUBLICATIONS

Merriam-Webster dictioanry for "bead".*

(Continued)

*Primary Examiner* — Bryon T Gyllstrom
*Assistant Examiner* — James M Endo
(74) *Attorney, Agent, or Firm* — Hayes Soloway PC

(57) ABSTRACT

In various embodiments, a lighting device is provided. The lighting device may include at least one first part and at least one second part, fastened to the first part, which first and second parts are interconnected by a potting compound, the parts being positively interconnected by the potting compound.

18 Claims, 5 Drawing Sheets

(51) Int. Cl.

| | |
|---|---|
| ***F21V 19/00*** | (2006.01) |
| ***F21K 9/23*** | (2016.01) |
| *F21K 9/90* | (2016.01) |

(56) References Cited

U.S. PATENT DOCUMENTS 2,317,035 A * 4/1943 Dana ..... F21S 48/1122 313/113
2,385,340 A * 9/1945 Baxter ..... H01J 5/50 174/50.5
3,014,196 A * 12/1961 Shappell ..... H01J 9/34 313/318.02
3,153,839 A * 10/1964 Pakswer ..... H01J 5/20 228/121
3,390,296 A * 6/1968 Perry ..... H01J 5/20 174/50.5
3,534,216 A * 10/1970 Wiley, Jr. ..... H01J 5/56 313/317
3,855,495 A * 12/1974 Pappas ..... H01J 5/56 313/318.02
4,221,453 A * 9/1980 Wagener ..... H01J 5/60 439/612
4,906,891 A * 3/1990 Takagi ..... H01J 5/56 313/318.02
4,949,007 A * 8/1990 Takagi ..... H01J 5/56 313/318.02
4,970,428 A * 11/1990 Hayakawa ..... F21V 19/008 313/318.02
4,974,131 A * 11/1990 Paradiso ..... F21V 19/008 362/217.05
5,130,604 A * 7/1992 Franks, Jr. ..... H01K 1/44 313/315
5,731,656 A * 3/1998 Greiler ..... H01R 33/02 313/318.01
7,015,632 B2 * 3/2006 Kobayashi ..... H01J 61/523 313/42
2003/0034723 A1 * 2/2003 Mehan ..... B29C 44/1228 313/318.01
2003/0155852 A1 * 8/2003 Cunkelman ..... H01J 5/54 313/318.03
2006/0181214 A1 * 8/2006 Moon ..... H01J 61/0672 313/607
2006/0227558 A1 10/2006 Osawa et al.
2007/0210687 A1 * 9/2007 Axelsson ..... F21V 17/04 313/26
2008/0143231 A1 * 6/2008 Johnson ..... H01J 5/62 313/318.01
2009/0026955 A1 * 1/2009 Otterstatter ..... H01J 5/58 313/624
2009/0200941 A1 * 8/2009 Klinedinst ..... H01J 5/58 313/565
2009/0278435 A1 * 11/2009 Sasai ..... H01J 5/58 313/317
2010/0290209 A1 * 11/2010 Chao ..... F21V 19/008 362/97.1
2011/0292653 A1 12/2011 Hofmann et al.
2013/0057147 A1 3/2013 Dellian

FOREIGN PATENT DOCUMENTS

DE 102010029515 A1 12/2011
FR 1099791 A * 9/1955 ..... H01J 5/54
GB 714562 A * 9/1954 ..... H01J 5/54

OTHER PUBLICATIONS

Philips, Lampe, Sep. 9, 1955, FR1099791A, English.*
Office Action issued in the corresponding German application No. 10 2012 222 103.4, dated Sep. 17, 2013, 5 pages.

* cited by examiner

LIGHTING DEVICE INCLUDING INTERCONNECTED PARTS

CROSS-REFERENCE TO RELATED APPLICATION

This application claims priority to German Patent Application Serial No. 10 2012 222 103.4, which was filed Dec. 3, 2012, and is incorporated herein by reference in its entirety.

TECHNICAL FIELD

Various embodiments relate generally to a lighting device, e.g. a semiconductor lighting device, having at least one first part, e.g. a glass part, and at least one second part, e.g. a non-glass part, fastened to the first part, which first and second parts are interconnected. Various embodiments may be applied e.g. to retrofit lamps, e.g. LED retrofit lamps.

BACKGROUND

In the case of conventional lamps and lamps based on light-emitting diodes (LEDs) as light sources, glass parts are used and, depending on the function and design, have to be connected to non-glass parts, for example a glass bulb to a heat sink of aluminum; a glass tube to end caps of plastic, etc. Plastic, ceramic and aluminum are often used as the material of the non-glass parts. A known technique for such connections is the adhesive bonding of opposing surfaces with adhesive or sealing substances. A great uncertainty in the adhesive-bonding technique is the lifetime stability over several years. This may differ considerably in the respective adhesive-bonding application, depending on the loading, the adhesive substance used and the design of the adhesive bond. Elaborate tests, long approval times and quality assurance involving a great effort are the direct consequences. In respect of the lifetime stability of adhesive bonds, a distinction is essentially drawn between two failure mechanisms, to be specific on the one hand an adhesive failure or bonding failure and on the other hand a cohesive failure or failure of the strength of the bonding substance. Measures that have been used so far to counteract an adhesive failure include, for example, improved cleaning of the surfaces to be adhesively bonded, activation of the surfaces to be adhesively bonded by special methods of pretreatment (plasma treatment, flame treatment, etc.), increasing the size of the surfaces to be adhesively bonded, use of so-called primers or use of specially formulated adhesive substances. All of these additional methods are cost-intensive.

Measures for reducing the risk of a cohesive failure are based on finding a suitable composition of the adhesive substance and suitable processing of the adhesive substance.

SUMMARY

In various embodiments, a lighting device is provided. The lighting device may include at least one first part and at least one second part, fastened to the first part, which first and second parts are interconnected by a potting compound, the parts being positively interconnected by the potting compound.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
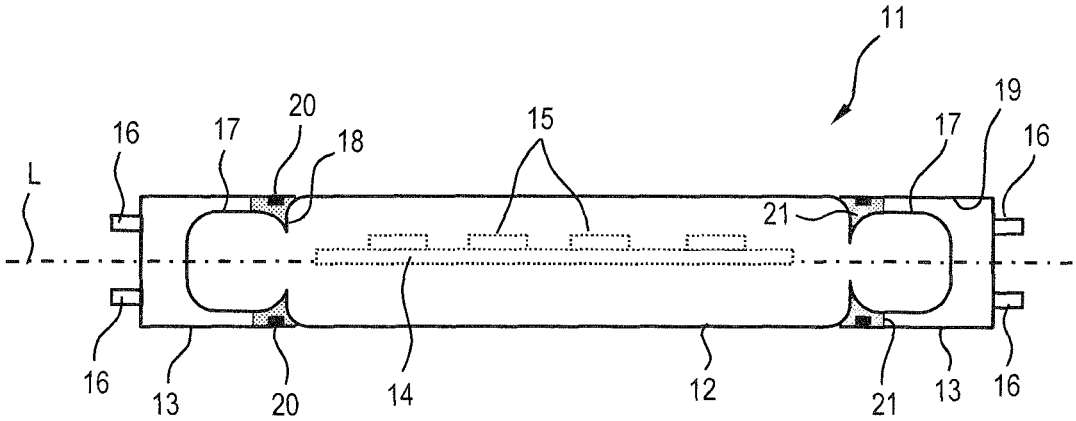
FIG. 1 shows a tubular lighting device according to a first embodiment as a sectional representation in side view.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may overcome at least partially the disadvantages of the prior art and e.g. to provide an improved possible way of counteracting an adhesive failure of a bonding substance, in particular between a glass part and a non-glass part of a lighting device.

Various embodiments provide a lighting device, having at least one first part and at least one second part, fastened to the first part, which first and second parts are interconnected by a potting compound, the parts being positively interconnected by the potting compound. This reduces mechanical loading of the connection of the potting compound to the parts considerably and prevents an adhesive failure in an inexpensive way. The lower mechanical loadings of the potting compound also have the effect that the onset of a cohesive failure is delayed or may even be prevented within a typical lifetime. In this case it is possible in particular to exploit the fact that the potting compound typically takes on a greater volume than is the case with a conventional adhesive layer and, as a result, stresses are distributed better in the potting compound. In the state in which it can be applied, the potting compound can be easily introduced into the lighting device and, in the cured state, creates the link between the two parts that establishes the positive engagement.

A potting compound may be understood in principle as meaning any curable substance that can be applied. The potting compound may be, for example, an adhesive substance or sealing substance consisting of or comprising silicone, epoxy resin, acrylate, polyurethane or some other plastics compound. However, substances of inorganic chemistry on the basis of, for example, cement, ceramic or metal in the form of mastic or foam may also constitute such a substance or potting compound.

The positive engagement may come about in particular by the potting compound being introduced between the two parts (and contacting the two parts) as a volume of material (not just as a layer).

A development is that the lighting device is a semiconductor lighting device. For this purpose, the semiconductor lighting device may have at least one semiconductor light source. In various embodiments, the at least one semiconductor light source includes at least one light-emitting diode. In the presence of multiple light-emitting diodes, they may light up in the same color or in different colors. A color may be monochrome (for example red, green, blue, etc.) or multichrome (for example white). The light emitted from the at least one light-emitting diode may also be an infrared light (IR-LED) or an ultraviolet light (UV-LED). Multiple light-emitting diodes may produce a mixed light; for example a white mixed light. The at least one light-emitting diode may contain at least one wavelength-converting luminescent substance (conversion LED). The at least one light-emitting diode may take the form of at least one individually housed light-emitting diode or the form of at least one LED chip. Multiple LED chips may be mounted on a common substrate ("submount"). The at least one light-emitting diode may be equipped with at least one optical system of its own and/or shared optical system for beam guidance, for example at least one Fresnel lens, collimator, and so on. Instead of or in addition to inorganic light-emitting diodes, for example on the basis of InGaN or AlInGaP, organic LEDs (OLEDs, for example polymer OLEDs) can also generally be used. Alternatively, the at least one light source may, for example, have at least one diode laser.

The semiconductor lighting device may be in particular a retrofit lamp, that is to say be configured for replacing a conventional lamp.

There is one configuration in which a base material of the parts differs. The present material-bonding connection is particularly advantageous for this, since it withstands particularly well the effects of a different thermal expansion under changing thermal load (as occurs particularly strongly when switching lighting devices on and off).

The first part and the second part are e.g. separately produced parts.

There is another configuration in which one of the parts is a glass part and another of the parts is a non-glass part. In various embodiments, the glass part may be a light-transmissive bulb.

There is in addition a configuration in which at least one of the parts, e.g. both parts, has at least one undercut that is at least partially embedded in the potting compound. This allows this part to be held particularly simply by positive engagement.

There is another configuration in which at least one of the parts has at least one recess that is filled with the potting compound. As a result, the recess forms an undercut, which establishes the positive engagement.

There is also a further configuration in which the recess is formed as a constriction. This allows a running-around, or at least elongate, undercut to be produced in a simple way, specifically even in thin-walled parts.

There is moreover a configuration in which at least one of the parts has at least one projection protruding into the potting compound. This also allows a positive engagement to be achieved in a simple way, e.g. by an undercut.

Generally, a part may have both at least one recess and at least one projection, for example if this part has a wall that is not straight in profile, for example curved.

There is furthermore a configuration in which at least one of the parts has a free periphery formed as a bead. A particularly stable, all-round positive engagement can be achieved in this way. There is also a configuration in which the bead is embedded in the potting compound, in particular is completely embedded in the potting compound. A development of this is that the bead is inserted in a corresponding recess of the other part and the recess is at least partially filled with the potting compound.

There is another configuration in which at least one of the parts has a (wall-like) peripheral region that is curved in profile, which is at least partially embedded in the potting compound. The curvature has the effect that at least one undercut for establishing the positive engagement is produced in a particularly simple and material-saving way.

There is also a further configuration in which the lighting device is a tubular retrofit lamp and the first part is formed as a long (straight and/or curved) light-transmissive bulb, an end cap being formed at at least one end of the bulb as a second part. Such a lighting device may, for example, be a retrofit or replacement lamp for a conventional fluorescent lamp, tubular lamp, etc.

There is also a configuration in which the glass part has a constricted end region with a reduced cross section, which is covered by the end cap, and the constriction being filled with the adhesive substance. This allows the undercut or the positive engagement of the glass part in particular as the first part to be accomplished in an easily achievable way by conventional glass working methods.

There is another configuration in which the lighting device is an incandescent retrofit lamp and the first part is formed as a light-transmissive bulb, a base part being formed on a periphery of the bulb as the second part. In various embodiments, the (free) periphery of the bulb may be inserted in a running-around groove of the base part. The first part may e.g. be inserted in a heat sink or heat sink region of the base part.

FIG. 1 shows a tubular lighting device 11 in the form of an LED retrofit lamp, for example for the replacement of a fluorescent lamp or a tubular lamp, etc., as a sectional representation in side view. The lighting device 11 has a light-transmissive glass bulb 12 of a cylindrical basic form as a glass part, on the end regions of which a cylindrical end cap 13 is respectively mounted as a non-glass part. In the glass bulb 12 there is a circuit board 14, on which multiple light-emitting diodes 15 are arranged for producing the light (indicated by dashed lines). The end cap 13 may, for example, consist of metal and/or plastic and it has at the ends electrical contacts in the form of contact pins 16. In one of the end caps 13 there may be arranged a driver for operating the light-emitting diodes 15 (top of the figure).

Figure 2:
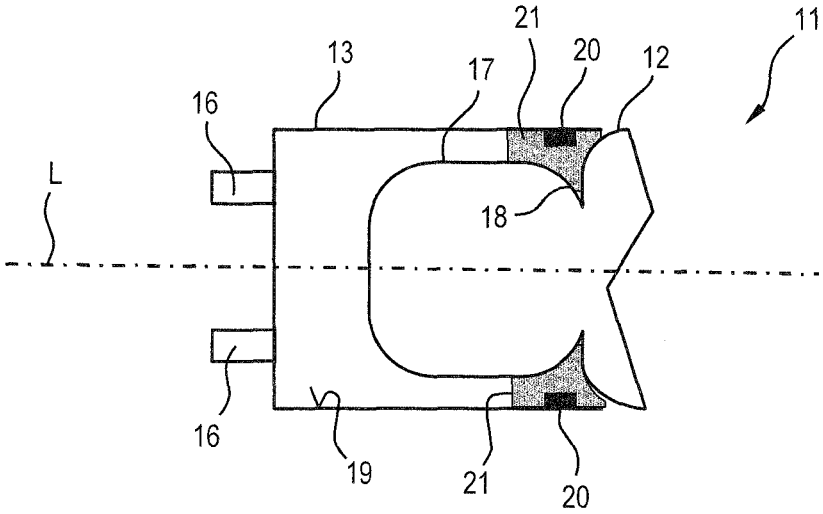
FIG. 2 shows a detail of the lighting device according to the first embodiment in the region of an end cap.

As shown enlarged in FIG. 2, the glass bulb 12 has respectively at the ends an end region 17 of reduced diameter for the connection to the end caps 13. The end region 17 may, as shown, be in one part or integral with the rest of the glass bulb 12 or alternatively may have been produced separately and then connected undetachably to the rest of the glass bulb 12, for example have been attached by a rolling or forming operation. The end region 17 and the rest of the part of the glass bulb 12 that receives the light-emitting diodes 15 form a constriction 18 that runs around a longitudinal axis L and has a still further reduced cross section (here: diameter), also referred to as a "constricted end region". The constriction 18 corresponds to a recess in the glass bulb 12.

The end caps 13 are fitted with their open end over the respective end region 17 of the glass bulb 12 or cover this region and therefore accommodate it. The end caps 13 have on their inner side 19 at least one projection 20, which is directed in the direction of the end region 17 of the glass bulb 12. The at least one projection 20 may, for example, be an annular projection or a group of multiple projections that are spaced apart from one another.

Between the end caps 13 and the glass bulb 12 there is a potting compound 21, for example silicone, adhesive substance, epoxy resin, etc., which is initially introduced in a flowable state and then cured. The potting compound 21 fills the constriction 18, and the at least one projection 20 is embedded in the potting compound 21. As a result, a positive connection that is particularly stable over a long time is established in a simple way between the glass bulb 12 and the end caps 13. For this purpose, the constriction 18 and the at least one projection 20 form corresponding undercuts. Provision of multiple projections 20 that are spaced apart around the longitudinal axis in the circumferential direction has the advantage that the positive engagement extends to turning of the glass bulb 12 and the end caps 13 about the longitudinal axis, and consequently not only prevents the end caps 13 from being pulled off from the glass bulb but also prevents them from being turned about the glass bulb 12.

Figure 3:
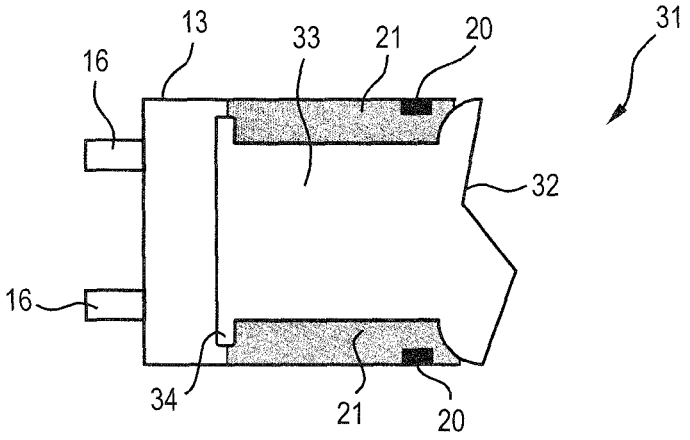
FIG. 3 shows a detail analogous to FIG. 2 of a tubular lighting device according to a second embodiment in the region of an end cap.

FIG. 3 shows a detail analogous to FIG. 2 of a tubular lighting device 31 in the region of an end cap 13. However, the glass bulb 32 then has a differently shaped end region 33. Specifically, there is no longer a constriction between the end region 33 and the rest of the glass bulb 32, but instead the end region 33 has at the end a laterally protruding bead 34, which serves as an undercut or stop. Alternatively, a correspondingly laterally projecting plate, which has been separately produced beforehand, may be applied to the end of the end region 33. This plate preferably consists of the same material as the bulb fastened thereto.

Figure 4:
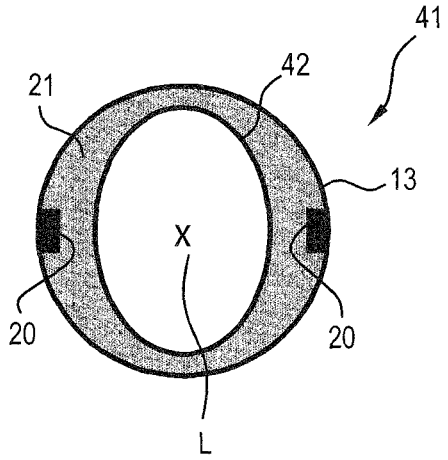
FIG. 4 shows a tubular lighting device according to a third embodiment as a sectional representation in longitudinal extent.

FIG. 4 shows a tubular lighting device 41 in the region of the end cap 13 as a sectional representation in longitudinal extent (that is to say looking along the longitudinal axis L). To establish a positive engagement also with respect to turning about the longitudinal axis L, here the glass bulb 42 is not formed as circular but oval in profile.

Figure 5:
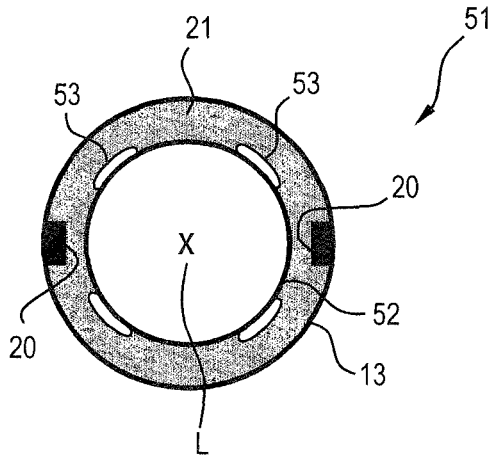
FIG. 5 shows a tubular lighting device according to a fourth embodiment as a sectional representation in longitudinal extent.

FIG. 5 shows a tubular lighting device 51 in the region of the end cap 13 as a sectional representation in longitudinal extent. The associated glass bulb has a circular basic form in profile. Here, to establish a positive engagement also with respect to turning about the longitudinal axis L, the glass bulb 52 has laterally protruding projections 53, which protrude into the potting compound 21 between the glass bulb 52 and the end cap 13 or are embedded by it.

Figure 6:
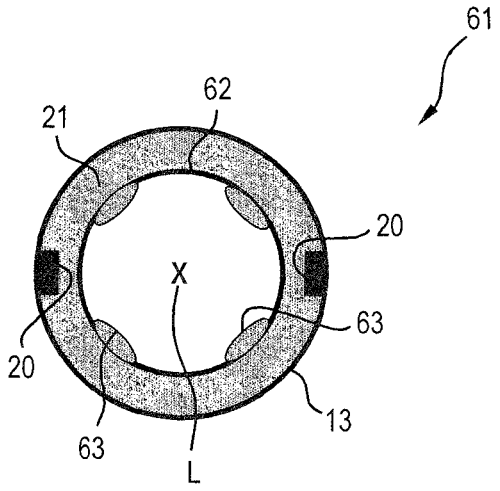
FIG. 6 shows a tubular lighting device according to a fifth embodiment as a sectional representation in longitudinal extent.

FIG. 6 shows a tubular lighting device 61 as a sectional representation in longitudinal extent. The associated glass bulb 62 has a circular basic form in profile and, to establish a positive engagement also with respect to turning, by contrast with the lighting device 51 has lateral recesses 63, which are filled with the potting compound 21.

Figure 7:
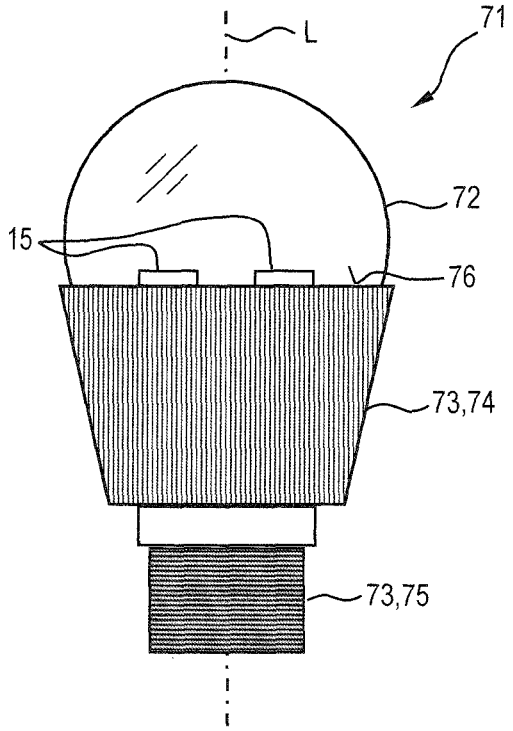
FIG. 7 shows a lighting device in the form of an incandescent lamp according to a sixth embodiment as a sectional representation in side view.

FIG. 7 shows a lighting device 71 in the form of an incandescent lamp, in the form of an LED incandescent retrofit lamp, as a sectional representation in side view. The lighting device 71 has multiple light-emitting diodes 15, which are arched over by a light-transmissive spherical or pear-shaped bulb 72, for example of glass or plastic. The light-emitting diodes 15 rest at least indirectly on a base region 73, e.g. on an upper portion 74 serving as a heat sink and possibly as a driver housing. The upper portion 74 may, for example, consist of aluminum. At its rear end with respect to its longitudinal axis L, the base region 73 has a base 75 in the actual sense, for example an Edison base.

Figure 8:
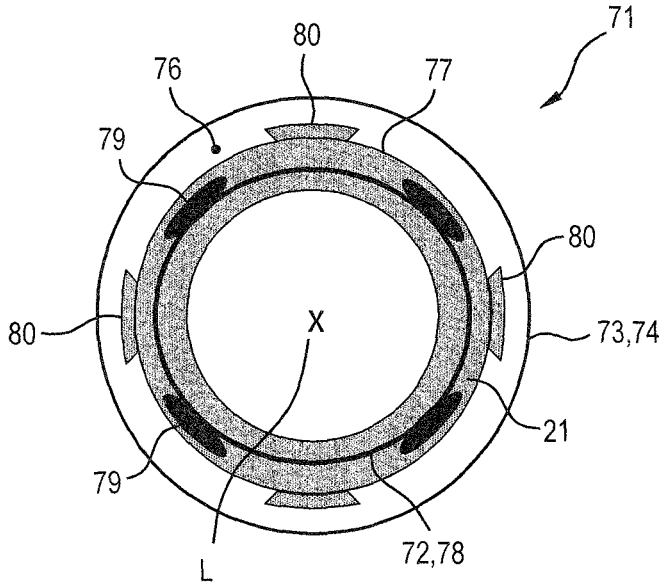
FIG. 8 shows the lighting device in the form of an incandescent lamp according to the sixth embodiment as a sectional representation in longitudinal extent.

While previously the bulb and the base part were adhesively bonded flat against one another, the base region 73 now has on its upper side 76, as shown in plan view along the longitudinal axis L in FIG. 8, a running-around groove 77, in which a lower peripheral region 78 of the bulb 72 is inserted. The groove 77 is filled with the potting compound 21, in order to establish a positive engagement. To form undercuts, the lower peripheral region 78 has multiple outwardly directed projections 79 that are spaced apart around the longitudinal axis L in the circumferential direction. For the same purpose, the groove 77 has multiple outwardly directed recesses 80 that are spaced apart around the longitudinal axis L in the circumferential direction and are filled with the potting compound 21.

Figure 9:
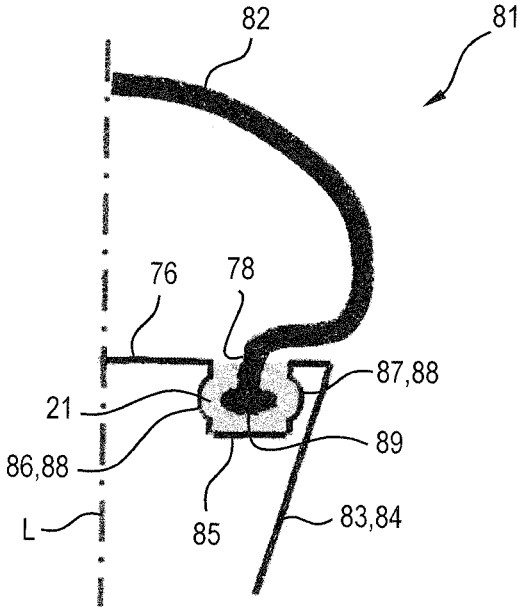
FIG. 9 shows a detail of a lighting device in the form of an incandescent lamp according to a seventh embodiment as a sectional representation in side view.

FIG. 9 shows a detail of a lighting device 81 in the form of an incandescent lamp as a sectional representation in side view, which has a structure similar to the lighting device 71, specifically with a bulb 82 and an upper portion 84 of a base region 83. The groove 85 has respectively in its inner side wall 86 and its outer side wall 87 multiple recesses 88 that are spaced apart from one another and are filled with the potting compound 21. The peripheral region 78 of the bulb 82 has an at least partially running-around bead 89, which in particular forms a free periphery of the bulb 82. The bulb 82 is held with positive engagement and possibly a material bond in the potting compound 21 by the bead 89 that is completely embedded in the potting compound 21, which in turn is held with positive engagement in the groove 85. The positive engagement is maintained even if there is no longer any adhesive connection between the bulb 82 and/or the base region 83 on the one hand and the potting compound 21 on the other hand. The potting compound 21 therefore may not even have a bonding or adhesive effect.

Figure 10:
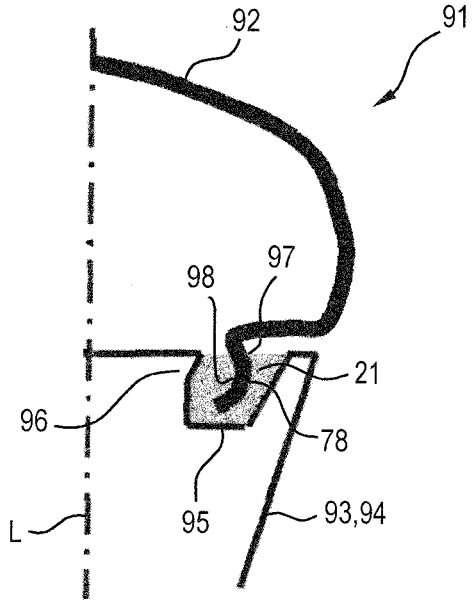
FIG. 10 shows a detail of a lighting device in the form of an incandescent lamp according to an eighth embodiment as a sectional representation in side view.

FIG. 10 shows a detail of a further lighting device 91 in the form of an incandescent lamp as a sectional representation in side view, which has a structure similar to the lighting device 71, specifically with a bulb 92 and an upper portion 94 of a base region 93. By contrast with the groove 85, the groove 95 does not have any recesses, but is inwardly directed at at least one wall portion 96, so that an undercut for the potting compound 21 located in the groove 95 that prevents the potting compound 21 from sliding out of the groove 95 is provided by this wall portion 96. To form an undercut at the peripheral region 78 of the bulb 92, the peripheral region 78 that is submerged, and consequently embedded, in the potting compound 21 is curved in profile and thereby at the same time forms a (here outwardly pointing) projection 97 and an (inwardly pointing) recess 98.

Although the invention has been more specifically illustrated and described in detail by the exemplary embodiments shown, the invention is not restricted to these, and other variations may be derived from them by a person skilled in the art without departing from the scope of protection of the invention.

In general, "a", "one", etc. may be understood as meaning a singular or a plural, in particular in the sense of "at least one" or "one or more", etc., as long as this is not explicitly excluded, for example by the expression "exactly one", etc.

A numerical indication may also include the indicated number exactly and also a customary tolerance range, as long as this is not explicitly excluded.

LIST OF DESIGNATIONS

11 Lighting device
12 Glass bulb
13 End cap
14 Circuit board
15 Light-emitting diode
16 Contact pin
17 End region
18 Constriction
19 Inner side
20 Projection
21 Potting compound
31 Lighting device
32 Glass bulb
33 End region
34 Bead
41 Lighting device
42 Glass bulb
51 Lighting device
52 Glass bulb
53 Projection
61 Lighting device
62 Glass bulb
63 Recess
71 Lighting device
72 Bulb
73 Base region
74 Portion
75 Base
76 Upper side
77 Groove
78 Lower peripheral region
79 Projection
80 Recess
81 Lighting device
82 Bulb
83 Base region
84 Upper portion
85 Groove
86 Inner side wall
87 Outer side wall
88 Recess
89 Bead
91 Lighting device
92 Bulb
93 Base region
94 Upper portion
95 Groove
96 Wall portion
97 Projection
98 Recess
L Longitudinal axis While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A semiconductor lighting device comprising:
at least one first part having:
at least one undercut; and
a periphery formed as a bead; and
at least one second part having at least one projection that is generally annular in shape, running circumferentially along an interior of the at least one second part with respect to a longitudinal axis of the at least one first part;
wherein the at least one first part and the at least one second part are arranged such that a cavity is formed between the at least one first part and the at least one second part, wherein the cavity is at least partially filled with a potting compound such that:
the at least one projection, the bead, and the at least one first part are at least partially embedded into the potting compound; and
the at least one undercut is filled with the potting compound;
wherein the at least one first part and the at least one second part are positively interconnected by the potting compound in an interlocking manner and only by the potting compound, wherein the positive interconnection is maintained even if the potting compound has no or no longer a bonding effect or an adhesive effect; and
wherein the potting compound does not occlude, in part or in whole, an opening of an end portion of the at least one first part.

2. The lighting device of claim 1, wherein the at least one undercut is formed as a constriction of the at least one first part.

3. The lighting device of claim 1, wherein the lighting device is a tubular retrofit lamp, the at least one first part being shaped as a long light-transmissive bulb, and wherein an end cap is formed on at least one end of the bulb as the at least one second part.

4. The lighting device of claim 3, wherein the bulb has a constricted end region with a reduced cross section, which is covered by the end cap, and the constricted end region is filled with the potting compound.

5. The lighting device of claim 1, wherein the positive interconnection prevents the at least one second part from being pulled off from the at least one first part and from being turned about the at least one first part.

6. The lighting device of claim 1, wherein the potting compound is a curable substance which is initially introduced between the at least one first part and the at least one second part in a flowable state and then cured, creating the positive interconnection between the at least one first part and the at least one second part.

7. The lighting device of claim 6, wherein the cured potting compound is selected from the group consisting of silicone, epoxy resin, acrylate, polyurethane, and a plastic compound.

8. The lighting device of claim 6, wherein the cured potting compound is selected from the group consisting of substances of inorganic chemistry on the basis of cement, ceramic, or metal.

9. The lighting device of claim 6, wherein the cured potting compound comprises at least one of mastic and foam.

10. The lighting device of claim 1, wherein the at least one projection aligns with the at least one undercut.

11. The lighting device of claim 1, wherein the at least one projection is offset in alignment with the at least one undercut.

12. The lighting device of claim 1, wherein the bead extends laterally with respect to a longitudinal axis of the at least one first part.

13. The lighting device of claim 1, wherein an end region of the at least one first part is only partially embedded into the potting compound.

14. The lighting device of claim 1, wherein the at least one projection is directed in a direction of an end portion of the at least one first part.

15. The lighting device of claim 1, wherein the at least one projection is generally rectangular in cross-sectional profile.

16. The lighting device of claim 1, wherein the potting compound covers an interior sidewall of the at least one second part up to a terminating edge of the at least one second part which interfaces with the at least one first part.

17. The lighting device of claim 1, further comprising at least one electrical contact pin extending from the at least one second part.

18. The lighting device of claim 1, wherein:

an end region of the at least one first part is only partially embedded into the potting compound; and the at least one projection is directed in a direction of the end portion of the at least one first part.

* * * * *